US007302776B2

(12) United States Patent
Duncan et al.

(10) Patent No.: US 7,302,776 B2
(45) Date of Patent: Dec. 4, 2007

(54) BAFFLED ATTIC VENT

(75) Inventors: Richard S. Duncan, Royersford, PA (US); Dustin Ciepliski, The Colony, TX (US)

(73) Assignee: Certainteed Corporation, Valley Forge, PA (US)

( * ) Notice: Subject to any disclaimer, the term of this patent is extended or adjusted under 35 U.S.C. 154(b) by 499 days.

(21) Appl. No.: 10/666,657

(22) Filed: Sep. 19, 2003

(65) Prior Publication Data

US 2005/0072072 A1 Apr. 7, 2005

(51) Int. Cl.
*F24F 7/02* (2006.01)
*E04B 7/18* (2006.01)
*E04D 13/17* (2006.01)

(52) U.S. Cl. ..... 52/95; 52/199; 52/302.1; 52/630; 454/260; 454/366

(58) Field of Classification Search ..... 52/95, 52/198, 199, 302.1, 630; 454/185, 260, 340, 454/365, 366
See application file for complete search history.

(56) References Cited

U.S. PATENT DOCUMENTS 2,477,152 A * 7/1949 Stevenson ..... 454/237
3,547,839 A * 12/1970 Tocker ..... 521/77
3,862,527 A * 1/1975 Peterson ..... 52/94
4,007,672 A 2/1977 Luckey
4,016,700 A * 4/1977 Blomstedt ..... 52/733.3
4,114,335 A * 9/1978 Carroll ..... 52/336
4,125,971 A 11/1978 Ward
4,126,973 A 11/1978 Luckey
4,197,683 A 4/1980 Ward
4,214,510 A 7/1980 Ward
4,237,672 A * 12/1980 Peterson ..... 52/742.1
4,280,399 A * 7/1981 Cunning ..... 454/365
4,406,095 A 9/1983 Slavik
4,446,661 A * 5/1984 Jonsson et al. ..... 52/95
4,660,463 A * 4/1987 Bottomore et al. ..... 454/260
4,903,445 A * 2/1990 Mankowski ..... 52/199

(Continued)

FOREIGN PATENT DOCUMENTS

CA 2 159 869 * 7/2004

(Continued)

OTHER PUBLICATIONS

DiversiFoam, Trade Literature, 4 pages, undated.

(Continued)

*Primary Examiner*—Robert Canfield
(74) *Attorney, Agent, or Firm*—Duane Morris, LLP

(57) ABSTRACT

Baffled attic vents and methods of their use and manufacture are provided. The baffled air vent of this invention includes an elongated member having a roof facing side and an attic space facing side, a pair of longitudinal side portions, first and second transverse ends, and at least one central panel portion. The vent defines at least one channel on the roof facing side thereof, for directing ventilated air. The channel includes a bottom portion having an integral baffled surface thereon. The vent further has an installed, convective air flow reading, under a 5 Pa air pressure differential, of at least about 95 CFM. Further embodiments contain separation means for permitting the attic vent to be separated by hand in a transverse or longitudinal direction.

9 Claims, 4 Drawing Sheets

U.S. PATENT DOCUMENTS

| | | | | | |
|---|---|---|---|---|---|
| 4,977,714 | A | * | 12/1990 | Gregory, Jr. | 52/95 |
| 5,341,612 | A | | 8/1994 | Robbins | |
| 5,596,847 | A | | 1/1997 | Stephenson | |
| 5,600,928 | A | * | 2/1997 | Hess et al. | 52/309.4 |
| 5,673,521 | A | * | 10/1997 | Coulton et al. | 52/199 |
| 6,023,915 | A | * | 2/2000 | Colombo | 53/432 |
| 6,346,040 | B1 | | 2/2002 | Best | |
| 6,347,991 | B1 | | 2/2002 | Bogrett et al. | |
| 6,357,185 | B1 | | 3/2002 | Obermeyer et al. | |
| 6,881,144 | B2 | * | 4/2005 | Hansen et al. | 454/365 |
| D511,848 | S | * | 11/2005 | Ciepliski | D25/141 |
| 7,094,145 | B2 | * | 8/2006 | Rye et al. | 454/366 |
| 2005/0054284 | A1 | * | 3/2005 | Ciepliski et al. | 454/365 |
| 2005/0072072 | A1 | * | 4/2005 | Duncan et al. | 52/198 |
| 2006/0105699 | A1 | * | 5/2006 | Kortuem et al. | 454/260 |

FOREIGN PATENT DOCUMENTS

| | | | | | |
|---|---|---|---|---|---|
| CA | 2 482 054 | | * | 3/2005 | |
| CA | 2 501 920 | | * | 9/2005 | |
| CA | 2 320 590 | | * | 11/2005 | |
| GB | 2145756 | A | * | 4/1985 | 52/199 |

OTHER PUBLICATIONS

Owens-Corning/Perma-R, Trade Literature, 1 page, undated.
DiversiFoam, Trade Literature, 1 page, undated.
Apache, Trade Literature, 1 page, undated.
ADO Products, Trade Literature, 1 page, undated.
Meyer, Trade Literature, 1 page, undated.
Practiv/Tenneco, Trade Literature, 1 page, undated.
Johns-Manville, Trade Literature, 1 page, undated.
Shelter Enterprises, Trade Literature, 1 page, undated.
Moore Products, Trade Literature, 1 page, undated.
Owens-Corning, RAFT-R-MATE®, Attic Rafter Vents, Trade Literature, 1 page, Sep. 27, 2006.
Owens-Corning, FoamulaR, Trade Literature, 2 pages, Feb. 1999.

* cited by examiner

Prior Art Competitor Design B

Prior Art Competitor Design C

Prior Art Competitor Design A

BAFFLED ATTIC VENT

FIELD OF THE INVENTION

This invention relates to baffled air vents located between adjacent roof rafters of a structure, and particularly to baffled air vents having improved, installed convective air flow readings.

BACKGROUND OF THE INVENTION

With an increasing emphasis on energy efficiency, attic insulation has often been supplemented by blown, loose-fill insulation, or by additional or thicker insulation bats to prevent heat loss in the winter and cool air loss in the summer. Unfortunately, thicker attic insulation can lead to poor air circulation when the spaces between the roof joists and the top wall plate of the building are closed or obstructed. These spaces must be left open to provide air flow between the soffit area and the attic space, for reducing excess humidity and heat, which have been known to deteriorate roofing and structural components. In order to keep this area open, baffled attic vents have been used.

The purpose of an attic vent is to prevent installed insulation, such as fiberglass bats, blankets, fiberglass and cellulose loose fill, from blocking the natural air flow from the ventilated soffit up through to the roof ridge vent or gable vents in the attic. Several attic baffled vents have been designed for this purpose. See, for example, U.S. Pat. No. U.S. Pat. No. 4,007,672 directed to a perforated block-style vent, U.S. Pat. No. 4,125,971 directed to a flat panel formed on site into an arch; U.S. Pat. No. 4,126,973 directed to a perforated block-style vent; U.S. Pat. No. 4,197,683 which is directed to the use of a vent board attached in the A-plane of a header board; U.S. Pat. No. 4,214,510 directed to a rolled sheet baffle design; U.S. Pat. No. 5,341,612 directed to the use of a longitudinal ridge in a roof vent for compressive stiffness; U.S. Pat. No. 5,596,847 directed to a vent having an integral transverse stiffening element integrated in the bottom offset wall; U.S. Pat. No. 5,600,928, directed to a vent having stiffeners in the form of saddles in the longitudinal ridges of the roof plane and gussets between offset, bottom surface and the inclined walls of the channel; U.S. Pat. No. 6,347,991, directed to a baffled vent having an integral hinge in a transverse direction, about 4-6 inches from one end; U.S. Pat. No. 6,346,040, directed to an integral vent and dam folded on-site from a flat sheet; and U.S. Pat. No. 6,357,185, directed to a vent having a sealable panel between the bottom of the baffle and the top of the header.

In addition, there are many commercial attic vents that are available for this purpose: PERMA-R® from Owens-Corning; CERTIVENT® from Diversifoam, Inc. A simple foam baffle available from Apache Products; DUROVENT® available from ADO Products; PROVENT® from an unnamed source; and products available from Pactiv; AEROVENT® from Shelter Enterprises, Inc.; and POLY-VENT PLUS® from Moore Products, LLC.

Most of the above mentioned patented or commercial baffled vents are vacuumed-formed extruded polystyrene foam. These designs provide for an open air flow area required by most building codes, while providing the stiffness to resist collapsing when the insulation is installed.

The features used to stiffen such vents, such as ribs and longitudinal stiffeners, unfortunately also restrict air flow. In some cases, such a restriction is counter productive to the purpose of the vent, but is unknown to the homeowner.

Accordingly, there is a present need for a baffled air vent which has structural integrity in both width and length, without sacrificing air flow.

SUMMARY OF THE INVENTION

In a first embodiment of the present invention, a baffled air vent for ventilating the air under a roof between a soffit area and an attic space is provided. The baffled air vent includes an elongated member having a roof facing side and an attic space facing side. It further includes a pair of longitudinal side portions, first and second transverse ends and at least one central panel portion. The elongated member defines at least one channel on the roof facing side thereof for directing ventilating air. The channel includes a bottom wall portion having an integral baffle surface. The attic vent creates an installed convective air flow reading, after insulation, under a 5 Pa air pressure air differential, of at least about 95 cubic feet per minute ("CFM").

The present invention employs an integral baffle surface disposed on a roof facing side of the vent for directing the air flow of vented air. In an improved embodiment, the air flow is only slightly affected, creating a resulting air flow of approximately 95-125 CFM. When compared to baffled vent designs having supporting structures of the "egg shell" or longitudinal pyramid design (such as prior art competitor designs A, B and C of FIGS. 5-7), the air vent baffles of the present invention produce significantly greater air flow.

In a further embodiment of the present invention, a baffled attic vent for ventilating air under a roof is provided. This vent includes an elongated member having a generally "W" shaped cross-section including a pair of longitudinal side portions and a pair of channels separated by a centrally located longitudinal rib. Each of the pair of channels includes first and second bottom wall portions. The elongated member further includes an integral baffle surface disposed on a roof facing side thereof. A transverse support is disposed at least along the first and second bottom wall portions of the pair of channels.

In a method of ventilating air in accordance with this invention, a first step is provided which includes providing a baffled air vent including an elongated member having an attic space facing side and a roof facing side, a pair of longitudinal side portions and a central panel portion. The central panel portion includes an integral baffle disposed along the roof facing side of said elongated member. The vent includes an installed convected airflow reading under about 5 Pa air pressure air differential, of at least 95 CFM. The method also provides a building having an enclosed room partially defined by a narrow wall, a horizontal upper wall plate, and a spaced-apart attic floor joist supported above the wall plate. A room ceiling depending from the joist and parallel inclined roof rafters are also provided. The roof rafters are spaced from each other by a predetermined distance and are supported above the wall plate and may extend beyond the outer wall. Some homes, of course, will not have eave overhangs, and in such cases, the baffled vent of this invention is particularly important for ventilation. Roof sheathing is fastened on the upper edges of the rafters and insulated material covers the ceiling to a substantial depth. In the final step of this method, the baffled attic vent is disposed between the pair of adjacent roof rafters and along the underside of the roof sheathing from a location beginning outside of the wall sheathing to well above the depth of the insulating material, so as to provide for air ventilation from a soffit area to an attic space.

In a further method of the present invention, a manufacturing method for making a baffle attic vent is provided. The method includes providing a polymeric insulation material, forming said polymeric insulation material into an elongated member having a pair of longitudinal sides, and a central panel portion disposed therebetween. This method further includes cutting the elongated member to a required length whereby the baffle vent has an installed convective air flow reading of not less than about 95 CFM, using a 5 Pa air pressure differential.

BRIEF DESCRIPTION OF THE DRAWINGS

The accompanying drawings illustrate preferred embodiments of the invention so far devised for the practical application of the principles thereof, and in which.

DETAILED DESCRIPTION OF THE INVENTION

Figure 1:
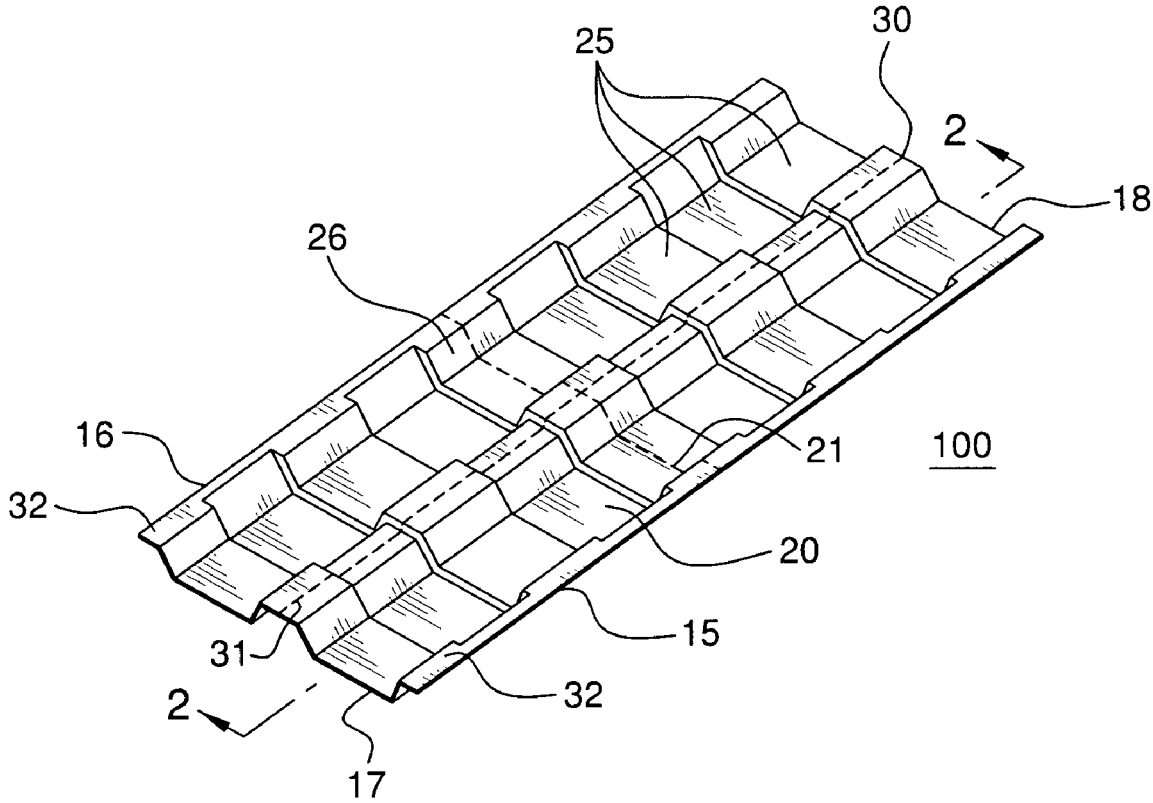
FIG. 1: is a front perspective view of a baffled air vent of this invention.

The air vent 100 of this invention can be manufactured from wood, sheet metal, cardboard, sheet plastic and foamed plastic, such as polyurethane or polyolefin foam, and most desirably, polystyrene foam. Suitable flame resistant materials, such as trisphosphate, hexabromocyclododecone, or equivalent material can be added to the base material. The vent 100 can be manufactured by vacuum molding, injection molding or a combination of extrusion and a forming step such as belt forming, in which the belt has a mold impression in it. The vent 100 is desirably 2-10 feet in length and about 1-3 feet in width.

This invention is directed to baffled attic air vents used under the roof of a building to ventilate air from a soffit area to an attic space. In accordance with the Figures, and particularly FIGS. 1 and 2 thereof, there is shown a preferred baffled attic vent 100 for ventilating air under a roof between a soffit area of the roof 101 and an attic space 102. The baffled attic vent 100 includes an elongated member having a roof facing side 12 and an attic space facing side 14. The elongated member includes a pair of longitudinal side portions 15 and 16, first and second transverse ends 17 and 18 and at least one central panel portion 20. The elongated member defines at least one channel, such as channels 22 shown in FIG. 4. The channel or channels 22 are disposed on a roof facing side 12 of the elongated member for directing ventilated air. The channels 22 include a bottom wall portion having an integral baffle surface 25 disposed thereon. The baffled attic vent 100 includes an installed convective air flow reading, under 5 Pa air pressure differential, of at least about 95 CFM.

In a preferred embodiment of the attic vent 100, a transverse support 26 is provided, which is either an embossed, molded or thickened portion of the attic vent 100 for providing lateral stability and support. Obviously, the transverse support can be repeated along the length of the attic vent 100 to provide transverse support in multiple locations. Additionally, a longitudinal rib 30 can be provided along the central portion of the attic vent 100 to provide longitudinal support.

In a further embodiment of this invention, the attic vent 100 can include a generally "W" shaped cross-section including the longitudinal side portions 15 and 16 separated by a centrally located longitudinal rib 30. Disposed on either side of the longitudinal rib 30 can be a channel 22 having first and second bottom wall portions. An integral baffle surface 25 can be disposed at least along the first and second bottom wall portions of the pair of channels 22. In a more preferred embodiment, the integral baffle surface can be disposed along substantially all or most of the roof facing side 12 of the attic vent 100, with the possible exception of the top surface of the flanges 32. In a preferred embodiment, the transverse support 26 forms a portion of the integral portion of the baffle surface 25.

Figure 2:
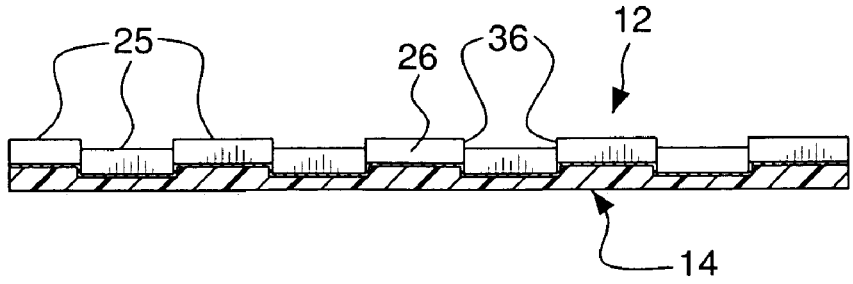
FIG. 2: is a side elevation, cross-sectional view of the air vent, taken through line 2-2 of FIG. 1.

In a more preferred embodiment, as shown in FIG. 1 and 2, the integral baffle surface 25 includes undulated, substantial planar surfaces of alternating height disposed along the first and/or second bottom wall portions of the pair of channels 22. The integral baffle surface 25 can include an embossed or molded surface having said alternative substantially planar regions, which are preferably separated by vertical steps 36 having a height of no greater than about 2.5 cm.

As shown in FIG. 2, the attic vent 100 of this invention can include an integral baffle surface 25, transverse support 26 and steps 36 which are molded, such as, for example, by vacuum forming, extrusion and belt forming or injection molding, onto the roof-facing side 12 of the attic vent 100. As illustrated, the attic-facing side 14 can be relatively smooth without features. Alternatively, the attic-facing side 14 can include embossed surface features which generally correspond to or mirror the features on the roof-facing side 12. The integral baffle surface 25 of FIGS. 1 and 2 has been modified so that the detail can be inspected, and is not drawn to scale.

Figure 3:
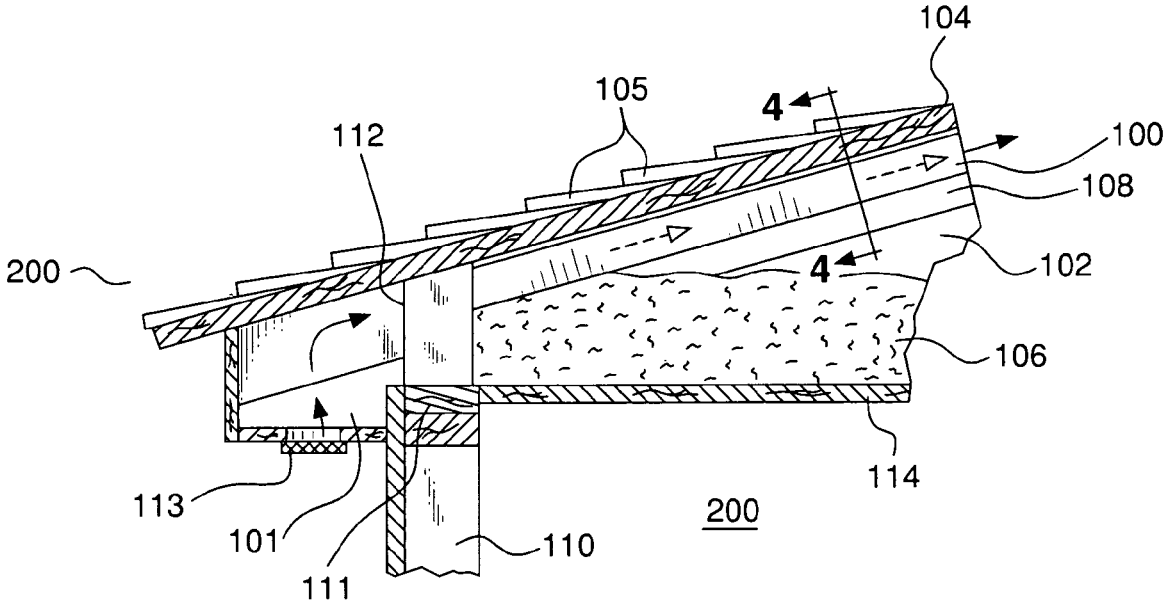
FIG. 3: is a partial side view of the baffled attic vent of this invention located under a roof of a structure.
Figure 4:
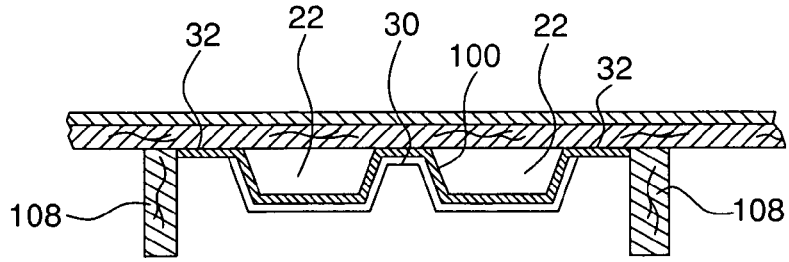
FIG. 4: is a side elevation, cross-sectional view of the installed attic vent, taken through line 4-4 of FIG. 3.

Referring to FIGS. 3 and 4, vent 100 is shown in relation to a structure or building 200. Vent 100 is positioned to provide a vent passage from the soffit area 101 to the attic space 102 of the building 200. Building 200 can be an industrial or a residential building, including a home, office, and like structures. Building 200 has the conventional top plate 111 located on top of an upright wall 110. A generally horizontal ceiling 114 extends inwardly from top plate 111. Roof rafters 108 extend upwardly from the top plate 111 and support the roof sheathing or boards 104. Conventional roofing shingles 105 are attached to the top of the roof sheathing or boards 104. The structure has the conventional openings 112 between the roof sheathing 104 and the top plate 111 and adjacent the roof rafters 108 which provide for the movement of air from soffit area 101 to attic space 102. Soffit area 101 has a vent 113 for allowing air to move into the soffit area 101 from below the roof overhang. The vent 113 and baffled attic vent 100, when assembled below roof sheathing or boards 104 provides an air passage space for allowing air to move from soffit area 101 to attic space 102. The vent 113 and baffle attic vent 100 allow insulation 106 to be placed above ceiling 114 and adjacent the wall plate 111. The vent 100 extends upwardly from plate 111. Baffled attic vent 100 prevents the insulation 106 from being blown into and/or closing soffit area 101.

Baffled attic vent 100 is installed between adjacent roof rafters 108. The roof rafters 108 are show in FIG. 4 and are, for example, 12", 16" or 24" on center.

Along the center of the centrally-located longitudinal rib 30 is a preferred single separator, such as a threaded pull string, score line, weakened area, crease or a longitudinal perforation 31 that allows the vent to be split in half to be installed in areas where the rafters 108 are spaced close together. The preferred double channel deign fits between rafters on 24" centers (most common). Splitting the double channel along this perforation 31 allows a single channel to be installed between rafters on 16" or 12" centers (less common).

A transverse separator, such as those described above, or preferably. a perforation 21 at the center of the longitudinal length may also be added. This is a feature that enables the installer to save materials using shorter (24" long) baffles in applications where, for example, the mass insulation on the attic floor is thin and/or the roof deck slope is at a high angle.

Baffled attic vent 100 can be molded or formed to accommodate such widths. In the preferred embodiment, flanges 32 are of sufficient width to permit a frictional fit within the rafters 108, without fasteners. Less preferably, adhesives or fasteners could be employed to attach the baffled attic air vent 100 to the roof sheathing 104 or side portion or bottom facing side of rafters 108.

In use, baffled attic vent 100 is placed between adjacent roof rafters 108 to provide a barrier for the insulation 106 located above the ceiling 114 and adjacent the top plate 111. The vent passage is maintained to insure the flow of air from soffit area 101 to attic space 102. The flanges 32 are in an outward direction and engage the inside of roof sheathing 104, side surface of rafters 108, or both. A plurality of fasteners, such as nails, staples, and the like, are optionally used to attach the flanges 32 to the roof sheathing or boards 104.

The vent and baffled attic vent 100 can be installed without special tools in new and existing structures. The installation is done with a minimum of time and labor.

EXAMPLE I

Figure 5:
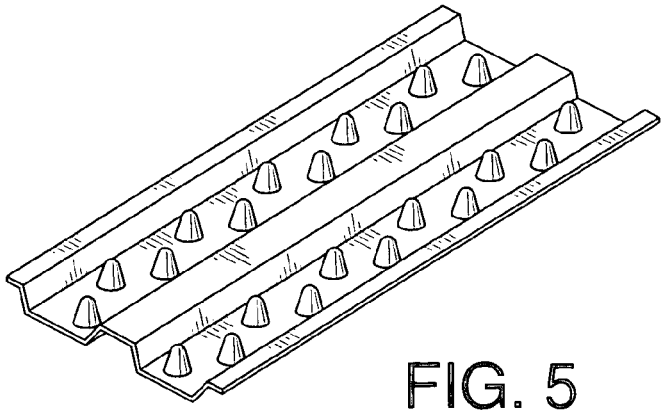
FIG. 5: is a front perspective view of a prior art competitive vent design.
Figure 6:
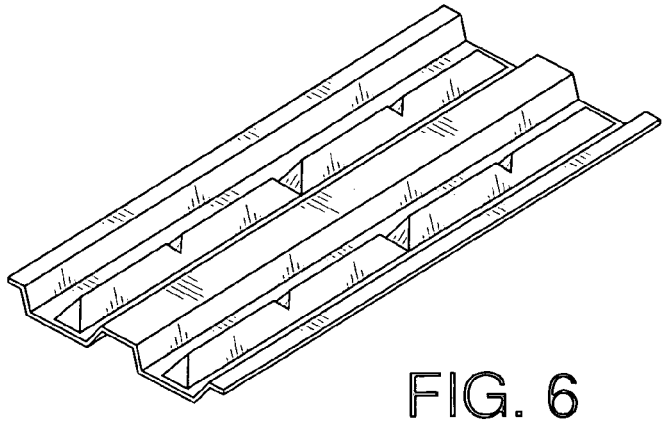
FIG. 6: is a front perspective view of another prior art competitive vent design.
Figure 7:
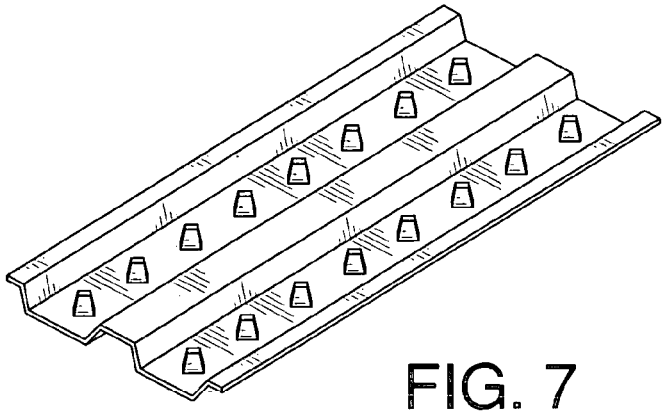
FIG. 7: is still another front perspective view of a prior art competitive vent design.
Figure 8:
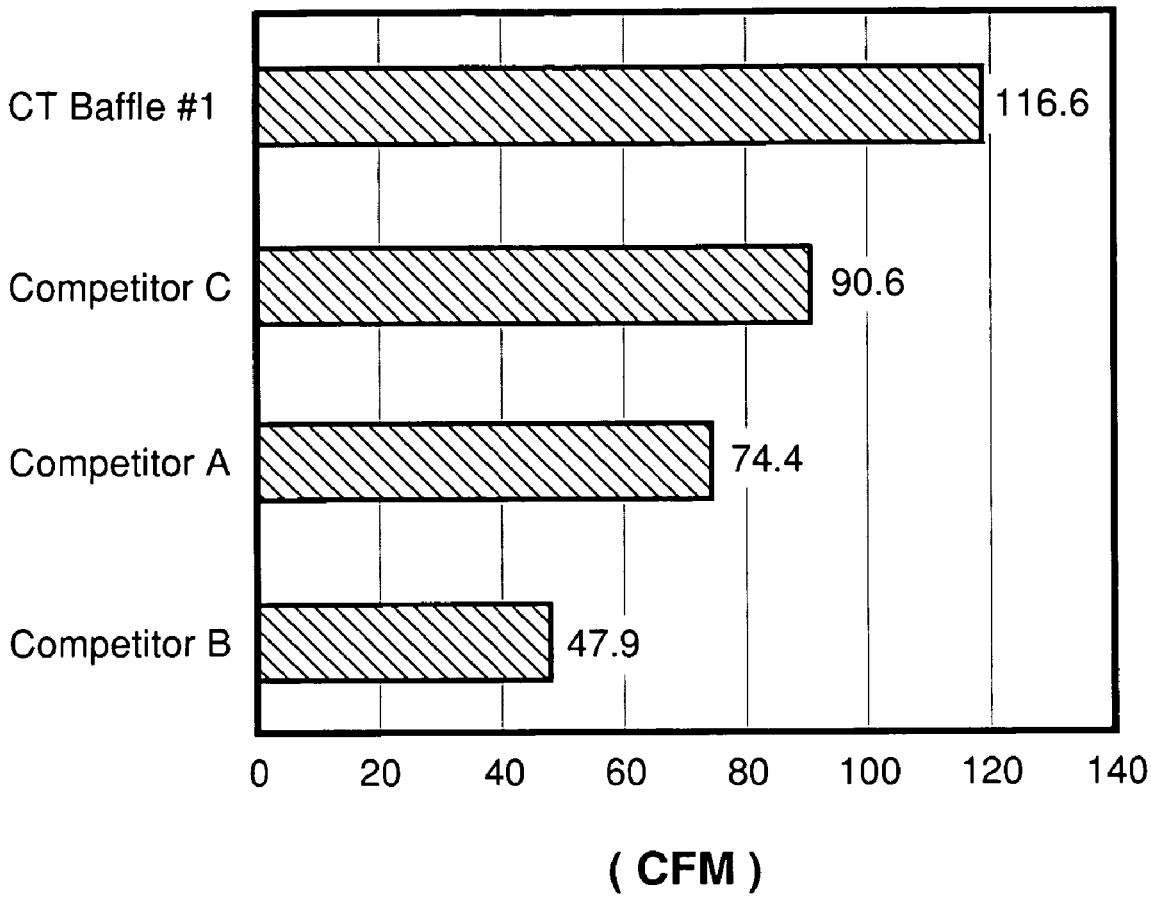
FIG. 8: is a bar chart depicting computer modeled convective air flow under a 5 Pa air pressure differential for the present invention versus the three competitive designs of FIGS. 5-7.

Computational fluid dynamic analyses were performed on the illustrative example of FIG. 1 and compared with prior art competitive designs A, B, and C of FIGS. 7, 5 and 6, respectively. The proposed attic air vent 100 of this invention has only a slight increase in air flow resistance with transverse stiffeners placed to cross the open channels. In the preferred embodiment, the present vent 100 does not use supports which extent substantially into the air path, as shown in competitive designs A and B, nor does it use longitudinal supports disposed substantially in the air path, like competitive design C. This results in improved natural convection air flow under a 5 Pa air pressure differential, as analyzed by the computational, computer analysis, as found in FIG. 8. The design of FIG. 1 showed improvement of about 31-147% in air flow over competitive designs, with an air-flow range of about 95-125 CFM preferred, and a target of about 118.6 CFM. This can be accomplished without sacrificing rigidity in either the longitudinal or lateral directions.

What is claimed is:

1. A baffled attic vent for ventilating air under a roof between a soffit area of said roof and an attic space, comprising:

an elongated member having a roof facing side and an attic space facing side, a pair of longitudinal side portions, first and second transverse ends and at least one central panel portion; said elongated member defining at least one channel on said roof facing side thereof for directing said ventilating air; said channel comprising a bottom wall portion having an integral baffle surface thereon, said attic vent having an installed convective airflow reading, under a 5 Pa air pressure differential, of at least about 95 CFM said vent comprising a centrally located longitudinal rib having a roof facing side thereof, said roof facing side of said centrally located longitudinal rib comprising a plurality of undulated planar surfaces of alternating height, said integral baffle surface comprising a plurality of undulated planar surfaces of alternating height.

2. The vent of claim 1 wherein said elongated member also comprises a traverse support disposed substantially along at least a bottom wall portion of said channel on said roof facing side of said elongated member.

3. The event of claim 2 wherein said transverse support forms a portion of said raised baffle surface.

4. The vent of claim 1 further comprising a flange integral with each of said pair of longitudinal side portions.

5. The vent of claim 1 wherein said undulated planar surfaces are separated by defined steps.

6. A baffled attic vent for ventilating air under a roof between a soffit area of said roof and an attic space, said vent forming a duct with the attic facing side of said root said vent comprising:

an elongated member having a generally "W"-shaped cross-section including a pair of longitudinal side portions and a pair of channels separated by a centrally located longitudinal rib; said pair of channels having first and second bottom wall portions, respectively; said elongated member further comprising an integral baffle surface disposed on a roof facing side of said elongated member, and a transverse support groove disposed at least along said first and second bottom wall portions of said pair of channels wherein said transverse support groove is disposed transversely across said elongated member, including across said centrally located longitudinal rib, between said pair of longitudinal side portions so as to provide transverse support to said vent.

7. The vent of claim 6 wherein said transverse support comprises a portion of said integral baffle surface.

8. The vent of claim 6 having an installed convective airflow reading, under a 5 Pa air differential, of at least 95 CFM.

9. The vent of claim 6 wherein said integral baffle surface comprises undulated substantially planar surfaces of alternating height disposed along said first and second bottom wall portions of said pair of channels.

* * * * *